US006896044B2

(12) United States Patent
Kato

(10) Patent No.: US 6,896,044 B2
(45) Date of Patent: May 24, 2005

(54) HEAT EXCHANGER

(75) Inventor: Soichi Kato, Saitama (JP)

(73) Assignee: Zexel Valeo Climate Control Corporation, Saitama (JP)

( * ) Notice: Subject to any disclaimer, the term of this patent is extended or adjusted under 35 U.S.C. 154(b) by 67 days.

(21) Appl. No.: 10/451,597

(22) PCT Filed: Dec. 26, 2001

(86) PCT No.: PCT/JP01/11490

§ 371 (c)(1),
(2), (4) Date: Jun. 24, 2003

(87) PCT Pub. No.: WO02/052213

PCT Pub. Date: Jul. 4, 2002

(65) Prior Publication Data

US 2004/0069469 A1 Apr. 15, 2004

(30) Foreign Application Priority Data

Dec. 26, 2000 (JP) ..... 2000-394710

(51) Int. Cl.[7] ..... F28F 9/02
(52) U.S. Cl. ..... 165/175; 165/173
(58) Field of Search ..... 165/153, 173–176

(56) References Cited

U.S. PATENT DOCUMENTS 5,076,354 A * 12/1991 Nishishita ..... 165/153
5,092,398 A * 3/1992 Nishishita et al. ..... 165/153
5,251,692 A * 10/1993 Haussmann ..... 165/153
5,307,870 A * 5/1994 Kamiya et al. ..... 165/173
5,329,990 A * 7/1994 Chigira ..... 165/153
5,896,923 A * 4/1999 Baba ..... 165/173
5,927,397 A * 7/1999 Yasuda et al. ..... 165/174
6,189,607 B1 * 2/2001 Hosoya et al. ..... 165/173
6,470,703 B2 * 10/2002 Wada et al. ..... 165/110

FOREIGN PATENT DOCUMENTS

JP 09113177 A * 5/1997

* cited by examiner

*Primary Examiner*—Leonard R. Leo
(74) *Attorney, Agent, or Firm*—Takeuchi & Takeuchi

(57) ABSTRACT

A heat exchanger provided with tubes 210 through which a medium flows and tanks 300 to which the ends of the tubes are connected to perform heat exchange of the medium with heat conducted to the tubes, wherein the tanks each provided with an end plate 320 having holes 321 for connection of the ends of the tubes and a tank plate 310 to which the end plate is fitted; and when it is assumed that a cross section of the tank in its longitudinal direction has a passage area X and a total wetted perimeter length Y for the medium, they have a relationship of $X=a\cdot Y^2/4\pi$ and $0.9\leqq a<1.0$.

2 Claims, 7 Drawing Sheets

HEAT EXCHANGER

TECHNICAL FIELD

The present invention relates to a heat exchanger which is provided with a plurality of tubes for flowing a medium through them and tanks connected to the ends of the plurality of tubes and which performs heat exchange of the medium by heat conducted to the tubes.

BACKGROUND ART

Generally, a heat exchanger such as a radiator, an evaporator or the like for a refrigerating cycle is configured by alternately stacking a plurality of tubes and a plurality of fins to form a core and connecting the ends of the tubes to tanks. The medium is taken into the inside through an inlet formed on the tank, flowed through the tubes while performing heat exchange by heat conducted to the core, and discharged to the outside through an outlet formed on the tank.

As the tank for such a type of heat exchanger, there are known tanks provided with an end plate having holes for connection of the ends of the tubes and a tank plate for mounting the end plate as described in, e.g., Japanese Patent Application Laid-Open Publications No. Hei 5-302794 and No. Hei 10-132485, Japanese Utility Model Application Laid-Open Publications No. Hei 2-133581 and No. Hei 3-56062, and Japanese registered Utility Model No. 2570322. In other words, the tank can be produced with ease by assembling the end plate and the tank plate in comparison with the production of the tank by rolling a single plate into a tube shape.

It is desired that the above-described heat exchanger can be produced with ease and configured to be able to secure desired pressure resistance, heat exchange efficiency, strength and others without fail. And the tank is still required to be further improved considering the above points.

The present invention has been made in view of the above circumstances and provides a heat exchanger having tanks configured rationally.

DISCLOSURE OF THE INVENTION

The invention is a heat exchanger provided with tubes through which a medium flows and tanks to which the ends of the tubes are connected, so as to perform heat exchange of the medium with heat conducted to the tubes, wherein the tanks, each is provided with an end plate having holes for connection of the ends of the tubes and a tank plate to which the end plate is fitted; and when it is assumed that a cross section of the tank in its longitudinal direction has a passage area X and a total wetted perimeter length Y for the medium, they have a relationship as shown below:

$$X=a\cdot Y^2/4\pi \quad (1)$$

$$0.9\leqq a<1.0 \quad (2)$$

The tank is configured rationally by the above structure. It's concept will be described below.

First, the passage for flowing the medium ideally has the shape of a circular tube considering a compressive strength only. But, the tank is advantageously formed not to be a perfect circular tube but an appropriate shape similar to it in view of the connection of tubes, and assembling of the end plate and the tank plate.

The shape of the passage for the medium in terms of the cross section of the tank in its longitudinal direction is a slightly deformed circle.

Here, when it is assumed that the circle has a diameter d, an area 0 and a circumference y, $$x=(d/2)^2\pi \quad (3)$$

$$y=d\pi \quad (4),$$

and elimination of d from the expressions (3) and (4) results in:

$$x=y^2/4\pi \quad (5)$$

where, π denotes the ratio of the circumference of a circle to its diameter.

The slightly deformed circle becomes to have the area x somewhat smaller than the circumference y, so that their relationship becomes the product obtained by multiplying the right side of the expression (5) by a value a slightly smaller than 1.

Therefore, the relationship between the passage area X and the total wetted perimeter length Y of the cross section of the tank in its longitudinal direction is indicated by the above-described expressions (1), (2).

Especially, the range of a in the expression (2) indicates that the shape of the passage is relatively similar to a circle, and it is a range to satisfactorily secure the pressure resistance of the tank.

The above range of a is preferably as follows in terms of the pressure resistance:

$$0.96\leqq a<1.0$$

An expression for determination of an equivalent diameter $d_e$ of the tank having a passage area X and a total wetted perimeter length Y is as follows:

$$d_e=4X/Y$$

And, an equivalent diameter $d_e$ of the tank according to the invention to a diameter $d_x$ of a circle having an area X meets the following:

$$d_e=a^{1/2}\cdot d_x$$

Thus, the present invention configures the tank rationally and secures its pressure resistance effectively.

The heat exchanger is a radiator for a refrigerating cycle and condenses the medium from a gas layer to a liquid layer, and the end plate and the tank plate of the tank are made of aluminum or its alloy, the passage area X for the medium is in a range of 150 to 220 [$mm^2$], and the end plate and the tank plate have a thickness in a range of 1.0 to 1.5 [mm].

The above heat exchanger has the tank configured more rationally.

Specifically, this heat exchanger is suitably used as a radiator for condensing the medium from the gas layer to the liquid layer, the aluminum or aluminum alloy endplate and tank plate are used, and the performance of the heat exchanger is taken into consideration to determine their thickness and the passage area of the medium to fall in a practical range.

The heat exchanger is a radiator for the refrigerating cycle and its inside pressure exceeds a critical point of the medium; and the tank has the end plate and the tank plate made of aluminum or its alloy, the passage area X for the medium is in a range of 12 to 160 [$mm^2$], and the end plate and the tank plate have a thickness in a range of 2.0 to 4.5 [mm].

By configuring as described above, the tank is configured more rationally.

Here, the critical point is a limit of a high temperature side of the state that the gas layer and the liquid layer coexist, namely a limit of a high pressure and one end of a steam pressure curve. The pressure, temperature and density at a critical point become a critical pressure, a critical temperature and a critical density. When the pressure in the heat exchanger exceeds the critical point of the medium, the medium is not condensed.

Specifically, the heat exchanger is suitably used as a radiator in which the pressure exceeds the critical point of the medium. The aluminum or aluminum alloy end plate and tank plate are used, the performance of the heat exchanger is taken into consideration, and their thickness and the passage area of the medium are determined to fall in a practical range.

BEST MODE FOR CARRYING OUT THE INVENTION

Embodiments of the invention will be described in detail with reference to the accompanying drawings.

Figure 1:
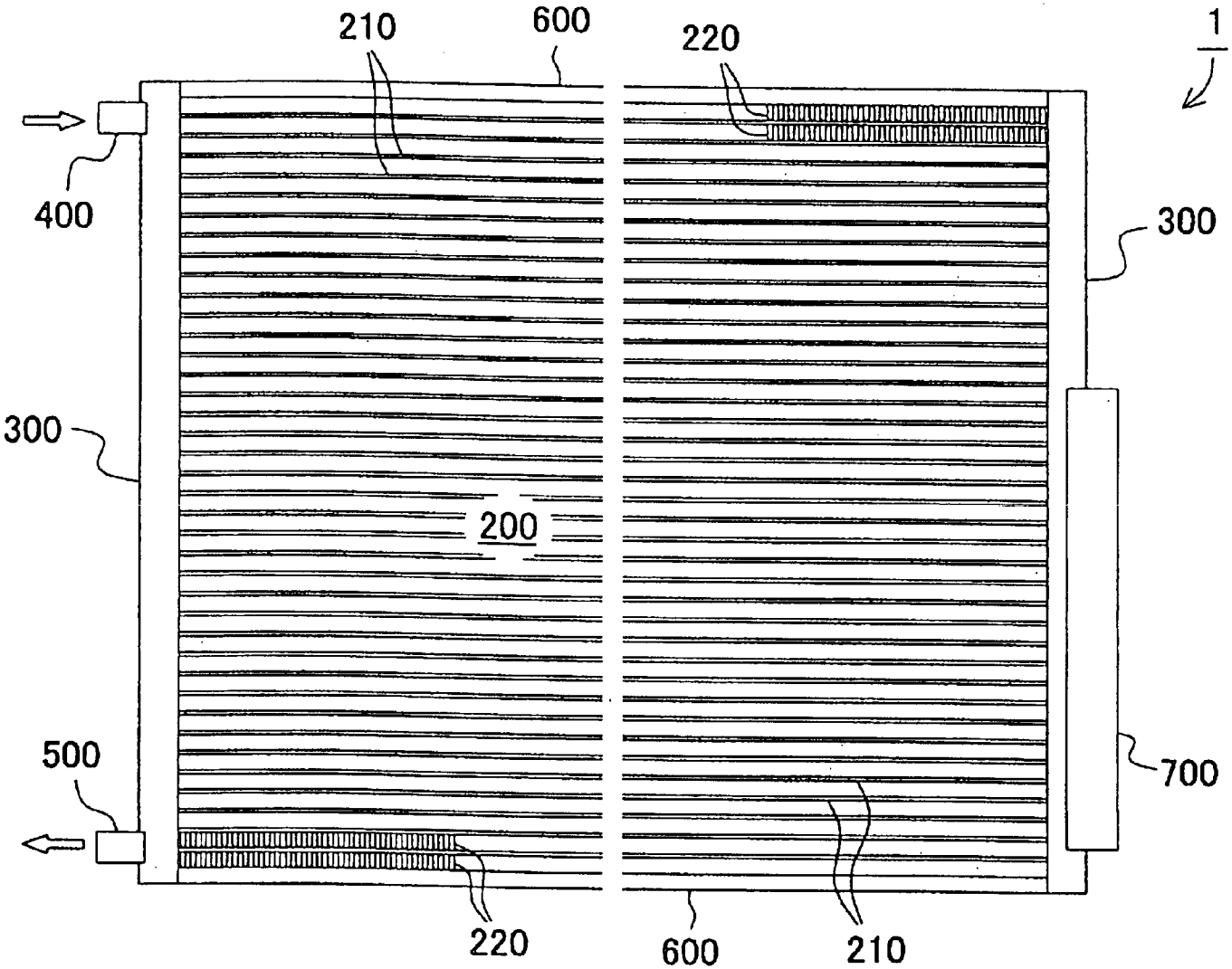
FIG. 1 is a front view of a heat exchanger according to an embodiment of the present invention.

A heat exchanger 1 of this embodiment is a radiator of an in-car air-conditioning refrigerating cycle mounted on vehicles, provided with a core 200 which has a plurality of tubes 210 for passing a medium (namely, a refrigerant) and a plurality of fins 220 alternately stacked and a pair of tanks 300 to which the ends of the tubes 210 are connected as shown in FIG. 1, and configured to perform heat exchange of the medium with heat conducted to the core 200.

The refrigerating cycle is to circulate a chlorofluorocarbon-based medium and provided with a compressor for compressing the medium, a radiator for cooling the compressed refrigerant, an expansion valve for decompressing the cooled refrigerant, and a steam evaporator for evaporating the decompressed refrigerant. In other words, the heat exchanger 1 of this embodiment as the radiator is a condenser which condenses from a gas layer to a liquid layer by cooling the medium.

The tank 300 is provided with an inlet 400 for introducing the medium and an outlet 500 for discharging the medium.

A fan (not shown) for feeding air to the core 200 is disposed on the outside adjacent to the core 200.

The medium is fed into the tank 300 through the inlet 400, flowed through the tubes 210 while performing heat exchange and discharged to the outside of the tank 300 through the outlet 500.

Each tank 300 is divided its interior at prescribed intervals, so that the medium goes and returns between the tanks 300 a plurality of times.

A side plate 600 as a reinforcing member is disposed on the top and bottom sides of the core 200. Ends of the respective side plates 600 are supported by the tanks 300.

A gas-liquid separator 700 is disposed on one of the tanks 300 to be configured that the medium being flowed from the inlet 400 to the outlet 500 is once sent from the tank 300 to the gas-liquid separator 700, and the liquid layer only is directed to the outlet 500.

And, the tubes 210, the fins 220, the tanks 300, the outlet 400, the inlet 500, the side plates 600 and the gas-liquid separator 700 configuring the heat exchanger 1 are formed into one body by assembling such members formed of aluminum or aluminum alloy and heating the assembly in a furnace. A clad layer of a brazing material and a flux coating are previously applied on key points of the respective members.

Especially, the tubes 210 of this embodiment are formed to be flat by extrusion molding or rolling of a plate. Their insides are divided into a plurality of sections to obtain a required pressure resistance.

Figure 2:
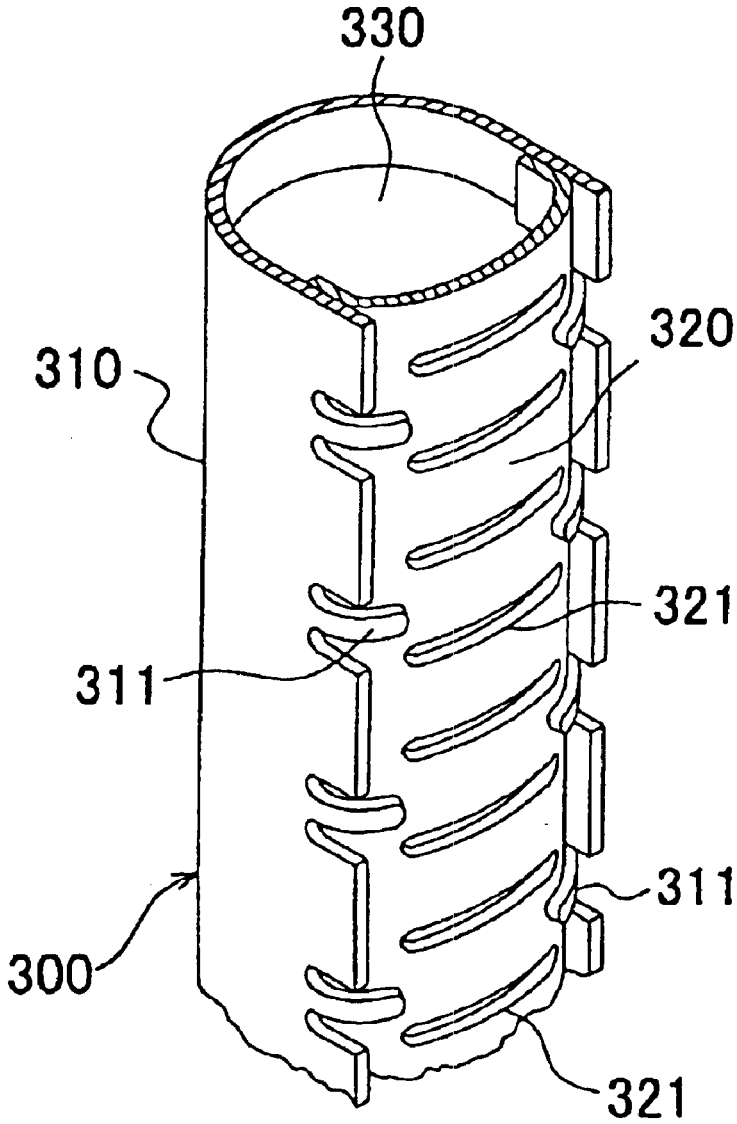
FIG. 2 is a perspective view showing relevant portions of a tank according to an embodiment of the invention.
Figure 3:
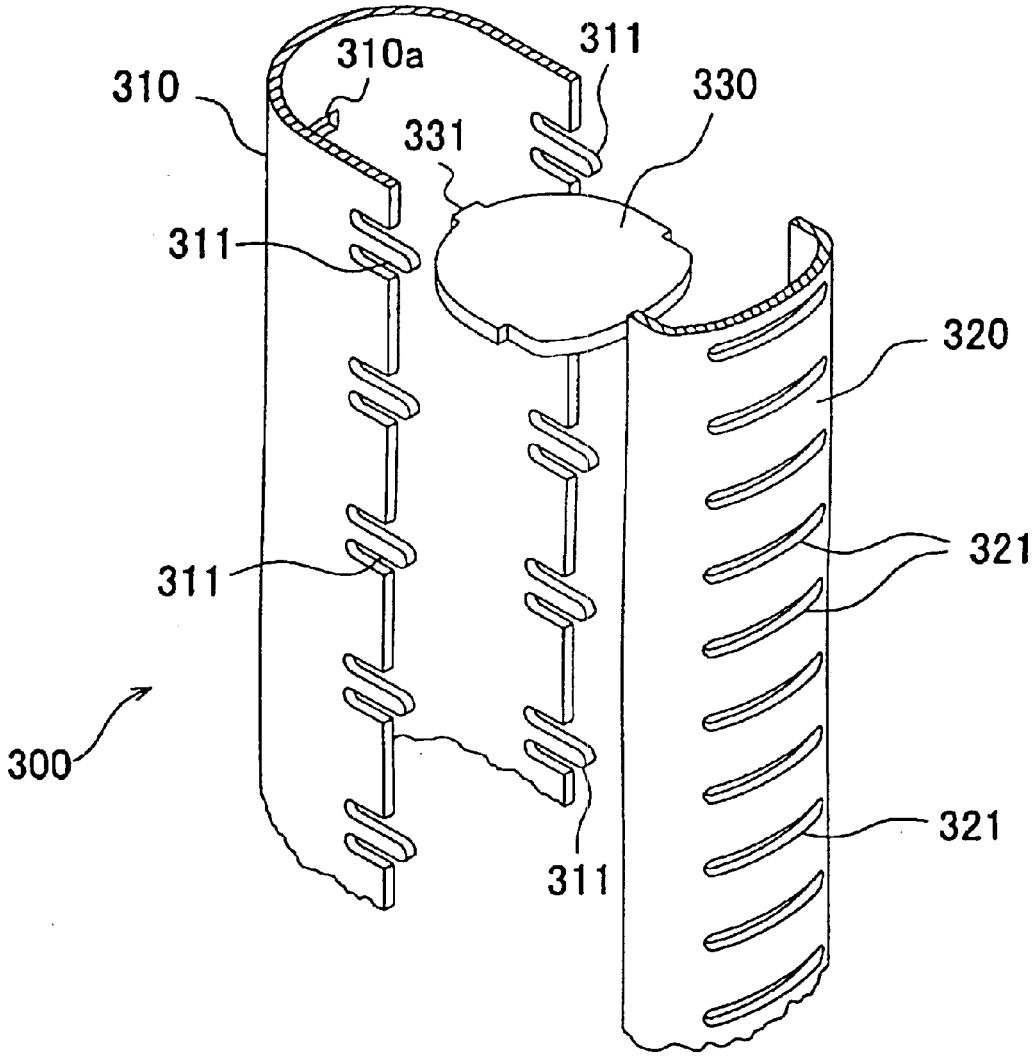
FIG. 3 is an exploded perspective view showing the relevant portions of the tank according to the embodiment of the invention.
Figure 4:
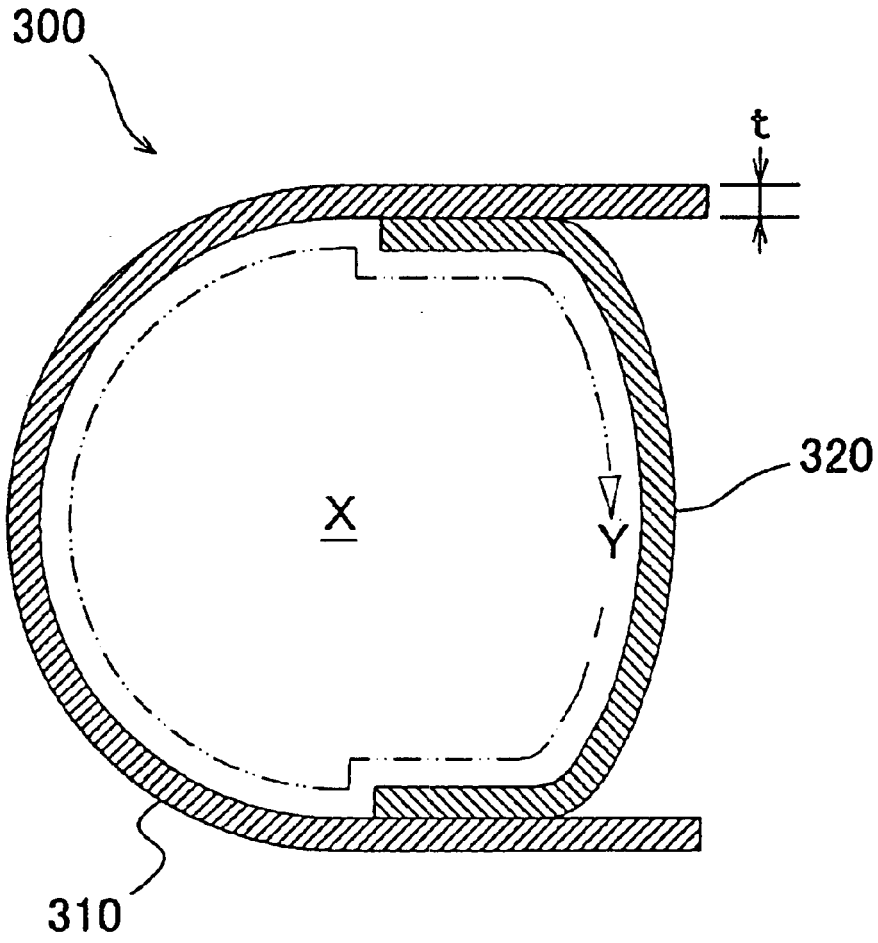
FIG. 4 is a sectional view of a tank in its longitudinal direction according to an embodiment of the invention.

As shown in FIG. 2 to FIG. 4, the tank 300 of this embodiment is configured by fitting an end plate 320 to a tank plate 310.

As to the pressure in the tank 300, a deformation pressure is 5.9 [MPa] or more, and a burst pressure is 9.8 [MPa] or more according to an experiment.

The tank plate 310 is a semicylinder member, and the end plate 320 is a member having holes 321 for insertion and connection of the ends of the tubes 210. And, the holes 321 of the end plate 320 are formed in plural at prescribed intervals along the longitudinal direction of the end plate 320.

Further, partition plates 330 are disposed at prescribed intervals between the tank plate 310 and the end plate 320. Specifically, the ends and interior of the tank 300 are sealed and divided by the partition plates 330.

The tank plate 310 and the end plate 320 are assembled with the end plate 320 mounted between both edges of the tank plate 310. An insertion amount of the end plate 320 is limited by the partition plate 330. Both edges of the end plate 320 are brazed to the inside circumference surface of the tank plate 310.

The partition plates 330 each has a projection 331 to be inserted into a hole 310*a* formed in the tank plates 310 and each partition plate is positioned by inserting the projection 331 into the hole 310*a*.

Besides, a plurality of bending pieces 311 for holding the end plates 320 are formed on the edges of the tank plate 310 at appropriate intervals. The end plate 320 is positioned on the tank plate 310 and fixed in position by bending the bending pieces 311. The bending pieces 311 are bent by pressing.

In this embodiment, the tank plate 310 and the end plate 320 each is formed by pressing an aluminum or aluminum alloy plate having a prescribed thickness t. The tank plate 310 and the end plate 320 each has the thickness t of 1.2 [mm], which is in a range of 1.0 to 1.5 [mm].

The end plate 320 is reinforced by connecting the ends of the tubes 210, so that its thickness may be determined to be slightly thinner than that of the tank plate 310. Otherwise, to improve the burst pressure at the ends of the tubes 210, the end plate 320 is determined to have a thickness slightly thicker than that of the tank plate 310.

Besides, for the cross section of the tank 300 in its longitudinal direction, a passage area X for the medium is 179.5 [$mm^2$] which is in a range of 150 to 220 [$mm^2$]. And, a total wetted perimeter length Y is 49.0 [mm].

When the passage area X and the total wetted perimeter length Y are substituted in the above-described expression ①, which is:

$$X=a\cdot Y^2/4\pi,$$

it is a≈0.939, then $0.9 \leqq a < 1.0$ is held.

Thus, the heat exchanger 1 of this embodiment has the tanks 300 configured very rationally and can be used suitably as a radiator for condensing the medium from the gas layer to the liquid layer.

Especially, the heat exchanger 1 is determined to have the tank plate 310 and the end plate 320 with a smaller thickness as the tank 300 is improved its pressure resistance. As a result, additional working was facilitated, the material cost was reduced, and a weight reduction was achieved.

Next, a second embodiment of the invention will be described with reference to FIG. 5.

Figure 5:
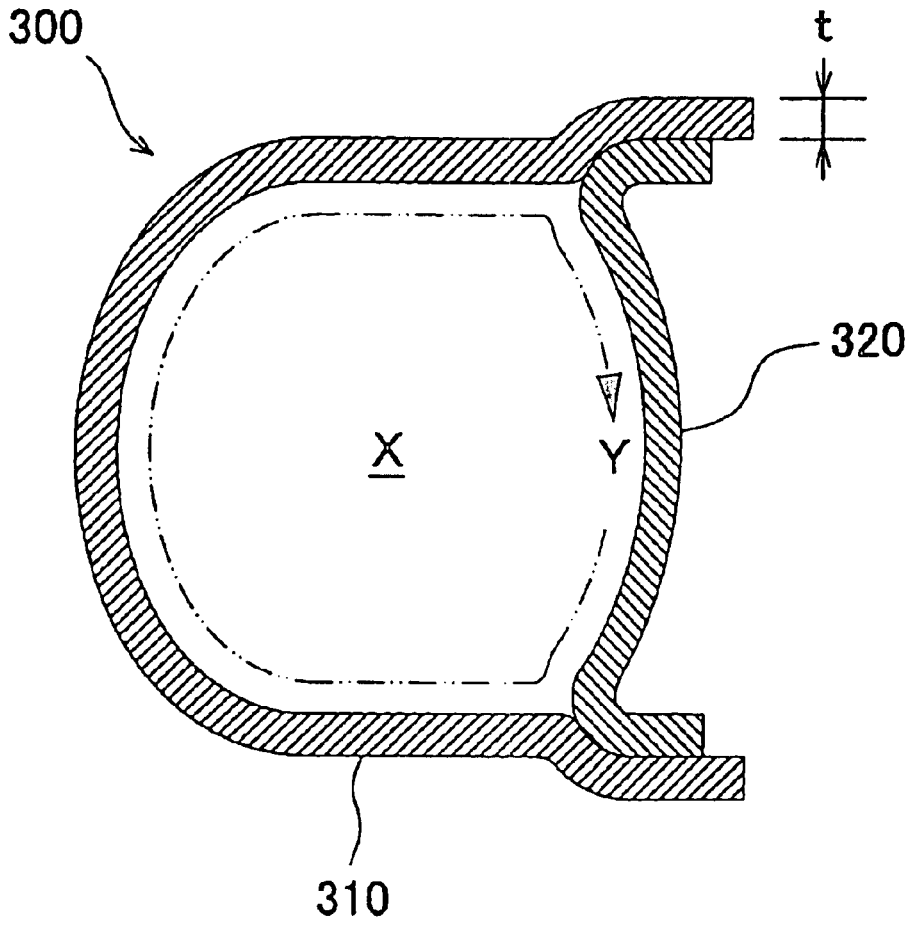
FIG. 5 is a sectional view of a tank in its longitudinal direction according to an embodiment of the invention.

As shown in FIG. 5, the tank 300 of this embodiment is formed by bending the edges of the end plate 320 toward the core and brazing the edges to the edges of the tank plate 310. Then, the end plate 320 is positioned to the tank plate 310 by means of shoulders formed on the tank plate 310.

In this embodiment, the tank plate 310 and the end plate 320 each has a thickness t of 1.3 [mm].

Besides, for a cross section of the tank 300 in its longitudinal direction, a passage area X for the medium is 160.7 [$mm^2$], and a total wetted perimeter length Y is 45.6 [mm].

Then, when the passage area X and the total wetted perimeter length Y are substituted in the following expression:

$$X = a \cdot Y^2 / 4\pi,$$

it is $a \approx 0.970$, then $0.9 \leqq a < 1.0$ is held.

Another basic structure is same as the previously described embodiment. The same reference numerals as those used in the previously described embodiment are used to denote the same members, and their description will be omitted.

The heat exchanger 1 of this embodiment has the tanks 300 configured quite rationally.

Especially, the tank plate 310 and the end plate 320 of this embodiment have a larger thickness t, a smaller passage area X and the medium passage with the shape more similar to a circle (i.e., value a is closer to 1.0) as compared with the first embodiment, thereby to further improve the deformation pressure and burst pressure of the tank 300.

If the same deformation pressure and burst pressure as in the first embodiment are to be obtained, the tank plate 310 and the end plate 320 can be made to have a thickness t smaller than 1.2 [mm].

Next, a third embodiment of the invention will be described with reference to FIG. 6 and FIG. 7.

The refrigerating cycle of this embodiment circulates $CO_2$ as a medium, and a gas-liquid separator is disposed between the steam evaporator and the compressor.

The heat exchanger 1 of this embodiment as its radiator has an inside pressure exceeding a critical point of the medium according to use conditions such as a temperature.

Figure 6:
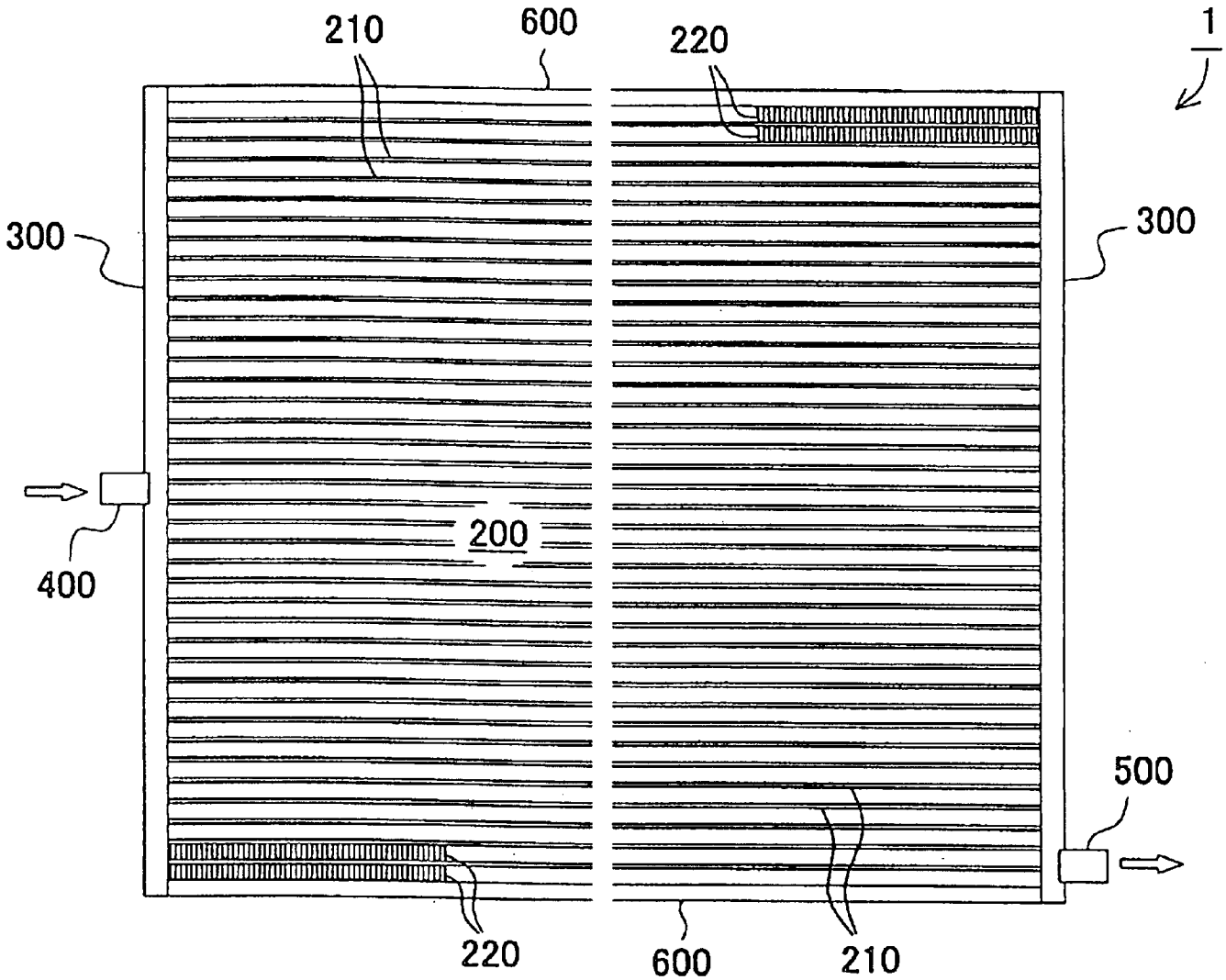
FIG. 6 is a front view of a heat exchanger according to an embodiment of the invention.

As shown in FIG. 6, the inlet 400 for the medium is disposed at the middle of one of the tanks 300, and the outlet 500 is disposed at the bottom end of the other tank 300.

Further, the tank 300 is not divided its interior, and the medium flows from one of the tanks 300 to the other tank 300 through the tubes and then discharged.

Figure 7:
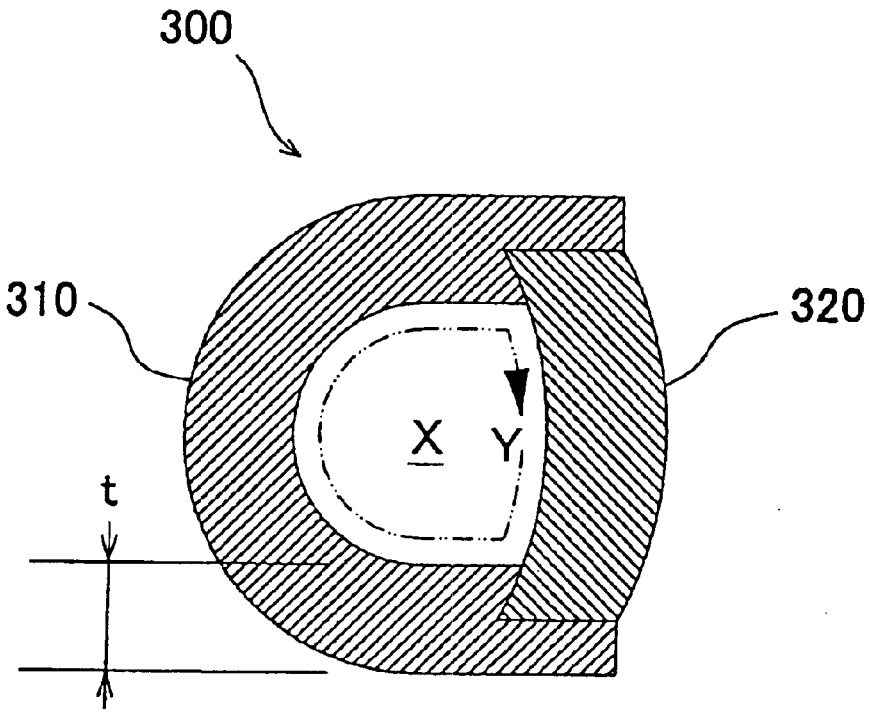
FIG. 7 is a sectional view of a tank in its longitudinal direction according to the embodiment of the invention.

As shown in FIG. 7, the tank 300 of this embodiment has the edges of the tank plate 310 formed to have cut-off parts and the edges of the end plate 320 fitted and brazed to the cut-off parts.

For the pressure in the tank 300, a deformation pressure is 22.5 [MPa] or more and a burst pressure is 45.0 [MPa] or more according to an experiment.

In this embodiment, the tank plate 310 and the end plate 320 have a thickness t of 2.5 [mm] which is in a range of 2.0 to 4.5 [mm].

Besides, for a cross section of the tank 300 in its longitudinal direction, a passage area X for the medium is 28.3 [$mm^2$] which is in a range of 12 to 160 [$mm^2$]. A total wetted perimeter length Y is 19.0 [mm].

Then, when the passage area X and total wetted perimeter length Y are substituted in the following expression:

$$X = a \cdot Y^2 / 4\pi,$$

it becomes $a \approx 0.985$, then $0.9 \leqq a < 1.0$ is held.

Another basic structure is the same as the previously described embodiment. The same reference numerals as those used in the previously described embodiment are used to denote the same members, and their description will be omitted.

Thus, the heat exchanger 1 of this embodiment has the tanks 300 configured rationally and can be suitably used as a radiator which has an inside pressure exceeding a critical point of the medium.

INDUSTRIAL APPLICABILITY

The present invention relates to a heat exchanger which is used for a general refrigerating cycle of vehicles, domestic air conditioners and others, and particularly suitable for a refrigerating cycle which uses, for example, $CO_2$ as a refrigerant and has an inside pressure of the radiator exceeding a critical point of the refrigerant.

What is claimed is:

1. A heat exchanger provided with tubes through which a medium flows and tanks to which the ends of the tubes are connected to perform heat exchange of the medium with heat conducted to the tubes, wherein:

the tanks each provided with an end plate having holes for connection of the ends of the tubes and a tank plate to which the end plate is fitted, the end plate and the tank plate have different curvatures, and both ends of one of them are brazed to be fixed to the inside of the other member;

a cross section of the tank in its longitudinal direction has a passage area X and a total wetted perimeter length Y for the medium, they have a relationship as $X = a \cdot Y^2 / 4\pi$ and $0.9 \leqq a < 1.0$; and the passage area X of the tank for the medium is in a range of 150 to 220 $mm^2$, and the end plate and the tank plate have a thickness in a range of 1.0 to 1.5 mm.

2. A heat exchanger provided with tubes through which a medium flows and tanks to which ends of the tubes are connected to perform heat exchange of the medium with heat conducted to the tubes and its inside pressure exceeding a critical point of the medium, wherein:

the tanks each provided with an end plate having holes for connection of the ends of the tubes and a tank plate to which the end plate is fitted;

a cross section of the tank in its longitudinal direction has a passage area X and a total wetted perimeter length Y for the medium, they have a relationship as $X = a \cdot Y^2 / 4\pi$ and $0.9 \leqq a < 1.0$; and the passage area X of the tank for the medium is also in a range of 12 to 160 $mm^2$, and the end plate and the tank plate have a thickness in a range of 2.0 to 4.5 mm.

* * * * *